US006251253B1

(12) United States Patent
Gillman et al.

(10) Patent No.: US 6,251,253 B1
(45) Date of Patent: Jun. 26, 2001

(54) METAL ALLOY SULFATE ELECTROPLATING BATHS

(75) Inventors: Hyman D. Gillman, Spring City, PA (US); Brenda Fernandes, Cranston; Kazimierz Wikiel, South Kingston, both of RI (US)

(73) Assignees: Technic, Inc.; Specialty Chemical Systems, Inc., both of Cranston, RI (US)

( * ) Notice: Subject to any disclaimer, the term of this patent is extended or adjusted under 35 U.S.C. 154(b) by 0 days.

(21) Appl. No.: 09/272,800

(22) Filed: Mar. 19, 1999

(51) Int. Cl.[7] ..... C25D 3/02

(52) U.S. Cl. ..... 205/239; 205/240; 205/241; 205/244; 205/246; 205/254; 205/255; 205/274; 205/281; 205/296; 205/302; 205/311; 205/242; 106/1.21; 106/1.25

(58) Field of Search ..... 205/239, 240, 205/241, 242, 244, 246, 254, 255, 274, 281, 296, 302, 311; 106/1.24, 1.25

(56) References Cited

U.S. PATENT DOCUMENTS

| | | | | |
|---|---|---|---|---|
| 2,525,942 | * | 10/1950 | Proell | 205/281 |
| 2,910,413 | * | 10/1959 | Strauss et al. | 205/281 |
| 3,616,306 | | 10/1971 | Conoby et al. | 204/54 R |
| 4,331,518 | | 5/1982 | Wilson | 204/43 |
| 4,347,107 | | 8/1982 | Teichmann et al. | 204/44 |
| 4,459,185 | | 7/1984 | Obata et al. | 204/43 |
| 4,717,460 | | 1/1988 | Nobel et al. | 204/444 |
| 4,828,657 | | 5/1989 | Fukuoka et al. | 204/44.4 |
| 4,871,429 | | 10/1989 | Nobel et al. | 204/44.4 |
| 5,051,154 | | 9/1991 | Bernards et al. | 204/24 |
| 5,066,367 | | 11/1991 | Nobel et al. | 204/44.4 |
| 5,174,886 | | 12/1992 | King et al. | 205/125 |
| 5,492,615 | | 2/1996 | Houman | 205/238 |
| 5,538,617 | | 7/1996 | Steinbicker et al. | 205/302 |
| 5,562,814 | | 10/1996 | Kirby | 205/238 |
| 5,759,381 | * | 6/1998 | Sakurai et al. | 205/253 |
| 5,897,763 | * | 4/1999 | Elligsen et al. | 205/271 |

FOREIGN PATENT DOCUMENTS

| | | |
|---|---|---|
| 0 455 166 A1 | 6/1991 | (EP) . |
| 0 787 834 A1 | 1/1997 | (EP) . |

OTHER PUBLICATIONS

Meibuhr et al., *Nobel Metal Resistors in Microcircuits,* "The Mechanism of the Inhibition of Stannous–Ion Oxidation by Phenolsulfonic Acid", vol. 2, No. 9–10 Sep.–Oct. 1964, pp. 267–273.

Lasia et al., "Double–layer effects in the kinetics of the $CD^{2+}$/CD (Hg) system in dimethylsulfoxide", *J. Electroanal. Chem.,*266 (1989), pp. 69–81. No Month Available.

Fawcett et al., "Double layer effects in the kinetics of electroreduction of zinc(II) at mercury in dimethylformamide and dimethylsulfoxide", *J. Electroanal. Chem.,*279 (1990), pp. 243–256. No Month Available.

Balch et al., "The solvent effect on the electrochemical behavior of $C_{60}$ films in the presence of alkali–metal cations", *Journal of Electroanalytical Chemistry* 427 (1997), pp. 137–146. No Month Available.

Lasia et al., "Mechanism ofo zinc(II) reduction in DMSO on mercury", *J. Electroanal. Chem.,* 288 (1990), pp. 153–164. No Month Available.

* cited by examiner

*Primary Examiner*—Kishor Mayekar
(74) *Attorney, Agent, or Firm*—Ernest V. Linek; Banner & Witcoff, Ltd.

(57) ABSTRACT

The use of alkali metal, alkaline earth metal, ammonium and substituted ammonium salts of alkyl and alkanol sulfonic acids as additives in pure metal and metal alloy sulfate electroplating baths has a number of unexpected benefits including wider useful current density range, improved appearance and in the case of tin improved oxidative stability. The metals and alloys include but are not limited to tin, nickel, copper, chromium, cadmium, iron, rhodium, ruthenium, iron/zinc and tin/zinc.

16 Claims, No Drawings

METAL ALLOY SULFATE ELECTROPLATING BATHS

CROSS-REFERENCE TO RELATED APPLICATIONS

The present invention is related to the following commonly owned co-pending applications filed on even date herewith; Metal alloy Halide Electroplating Baths, U.S. Ser. No. 09/272,550, still pending; Metal Alloy Fluoroborate Electroplating Baths, U.S. Ser. No. 09/273,119, now U.S. Pat. No. 6,279,985; and Metal Alloy Sulfonate Electroplating Baths, U.S. Ser. No. 09/272,551, now U.S. Pat. No. 6,183,619, all filed Mar. 19, 1999; the disclosure of which are hereby incorporated herein by reference.

BACKGROUND OF THE INVENTION

Electroplating solutions are usually aqueous. Every plating solution contains ingredients to perform at least the first, and usually several, of the following functions: (1) provide a source of ions of the metal(s) to be deposited; (2) form complexes with ions of the depositing metal; (3) provide conductivity; (4) stabilize the solution against hydrolysis or other forms of decomposition; (5) buffer the pH of the solution; (6) regulate the physical form of the deposit; (7) aid in anode corrosion; and (8) modify other properties peculiar to the solution involved.

The present invention improves the plating performance of the solution, particularly by increasing the useful current density over previously accepted norms. The current density is the average current in amperes divided by the area through which that current passes; the area is usually nominal area, since the true area for any but extremely smooth electrodes is seldom known. Units used in this regard are amperes per square meter ($A/m^2$).

It is also in the best interest of efficiency to run these plating baths at as high a current density as possible. The higher the current density the faster the coating plates on the surface. The current is carried by the ions in these baths and each type of ion has its own specific conductance. In plating bath, however, ionic conductance is only one variable that must be considered in choosing an electrolyte. The final criterion is the quality of the coating at the desired current density.

SULFATE BATHS

A variety of metals and metal alloys are commercially plated from solutions with sulfate as the primary anion. See for example U.S. Pat. Nos. 4,347,107; 4,331,518 and 3,616,306. Certain sulfate electroplating baths have limitations that can sometimes be alleviated with the addition of additives including other anions. For example the steel industry has been tin plating steel for many years from sulfuric acid/tin sulfate baths where phenol sulfonic acid is used as a special electrolyte additive which improves both the oxidative stability of the tin as well as increasing its current density range. This is known as the ferrostan process but because of environmental problems with phenol derivatives the steel industry is looking to replace this bath with one which is less harmful to the environment.

Similarly nickel sulfate is used for nickel plating but nickel chloride must also be present to provide enough conductivity and improve anode dissolution. This bath is known as the Watts bath but although economical, suffers from a number of disadvantages including a nickel plate that is highly stressed.

It is therefore worthwhile to identify other additives that can improve the performance of metal sulfate electroplating baths. There are many examples in the prior art where surfactants and other organic additives are used to provide a more desirable finish. In the case of tin the prior art also describes additives which can improve the oxidative stability of the tin and therefore provide a bath with less sludge formation. It is less common to find examples of additives which improve the plating range especially at the high current density end. Increasing the current density is a very desirable feature but it has been difficult to identify additives which can do this without creating other problems in the bath.

Many plating baths are also very sensitive to the presence of impurities and often as impurities build up in the bath they affect he quality of the deposit. Therefore either these impurities must be removed or the baths must be replaced. For example in tin plating steel, iron builds up in the bath and eventually affects the quality of the deposit and must be removed. It is very desirable to find additives that will make the bath less sensitive to these impurities.

SUMMARY OF THE INVENTION

The present invention relates to the use of alkali metal, alkaline earth metal, ammonium and substituted ammonium salts of alkyl and alkanol sulfonic acid which have been found to improve the performance of sulfate electroplating baths. When used in these electroplating baths these salt additives were found to generally increase the plating range so that these baths can be used at much higher current densities. Thus these baths can be run at greater speeds than those without these additives. Further improvements are seen in the quality of the deposits. In the case of stannous sulfate plating solutions, some improvements in the oxidative stability of the tin was also observed.

Thus, the present invention is directed to a method of improving the plating performance of an aqueous sulfate based electroplating bath comprising the step of adding an effective performance enhancing amount of a salt of an alkyl and/or alkanol sulfonic acid to said bath.

The salts used to improve the bath plating performance characteristics are particularly selected from the group consisting of alkali metal, alkaline earth metal, ammonium and substituted ammonium salts. Especially preferred are salts of 2-hydroxy ethyl sulfonic acid, especially the sodium salt (sodium isethionate).

The baths that can be improved by the present invention include tin and tin alloys, nickel and nickel alloys, copper and copper alloys, chromium and chromium alloys, cadmium and cadmium alloys, iron and iron alloys, rhodium and rhodium alloys, ruthenium and ruthenium alloys, and especially the iron/zinc and tin/zinc alloy plating baths.

DETAILED DESCRIPTION OF THE INVENTION

The use of alkali metal, alkaline earth metal, ammonium and substituted ammonium salts of alkyl and alkanol sulfonic acids as additives in pure metal and metal alloy sulfate electroplating baths has a number of unexpected benefits including wider useful current density range, improved appearance and in the case of tin improved oxidative stability.

Thus these baths can be run at greater speeds than those without these additives. Further improvements are seen in the quality of the deposits and greater tolerance to impurities such as iron. In the case of stannous sulfate plating solutions some improvements in the oxidative stability of the tin was also observed.

Unlike phenol sulfonic acid these salts are not harmful to the environment. They are completely biodegradable and the products of the biodegradation are common ions and molecules found in the environment. In addition they have a number of other advantages including high solubility, low corrosivity to equipment, good stability at high temperatures, and compatibility with many other metal salts.

These baths also contain the corresponding metal salt or metal salts if any alloy plate is required, and various additives to control the quality and appearance of the plated surface and the stability of the bath solution. Typical additives include a surfactant such as an ethoxylated fatty alcohol, a brightening agent if required and an antioxidant such as hydroquinone or catechol, if tin is one of the metals being plated.

The tin in these baths is in the stannous or reduced form. If oxidation occurs the tin will be converted to the stannic or oxidized form which then commonly precipitates to form a sludge. The process adds to the inefficiency of these baths and also creates a requirement for constant filtering. Several patents, for example U.S. Pat. Nos. 4,717,460, 5,538,617 and 5,562,814, describe additives and/or processes that can decrease the amount of tin being oxidized.

The present invention will be further illustrated with reference to the following example which will aid in the understanding of the present invention, but which is not to be construed as a limitation thereof. All percentages reported herein, unless otherwise specified, are percent by weight. All temperatures are expressed in degrees Celsius.

EXAMPLE #1

Laboratory plating baths were evaluated on the Hydrodynamically controlled Hull Cell with a 1 minute plate time at up to 30 Amps. Plating strips were made of steel and were pretreated by soaking for 15 seconds in an alkaline bath, rinsing then immersing for 15 seconds in 10% sulfiric acid and rinsing again. The following bath was evaluated to which various levels of sodium isethionate were added.

Bath Composition:

5% Sulfuric Acid 20.0 g/l Sn (as stannous sulfate)

3 g/l JWL 5000 surfactant 0.1 g/l salicylic acid Bath base 5 ppm 2.9-Dimethyl-phenanthroline

| Run # | Additive and Level | Results of Plating Tests |
|---|---|---|
| 1 | No additive | Dark burn on high current density edge at 5 Amps. Burn is 12 mm wide at high current density edge at 10 Amps. |
| 2 | 10 g/l Sodium isethionate (calculated as isethionic acid) | Even light gray satin deposit at 10 Amps-no burn. |
| 3 | 20 g/l Sodium isethionate (calculated as isethionic acid) | Even light gray satin deposit at 30 Amps-no burn. |
| 4 | 1 g/l Sodium Sulfate | Burn is 12 mm wide at high current density edge at 10 Amps. |
| 5 | 30 g/l Sodium Sulfate | Burn is 4 mm wide at high current density edge at 10 Amps. |

These results show that by adding sodium isethionate to this sulfate bath the current density range is increased significantly. A 15 Amp panel is indicative of current densities at 600 Amp/ft$^2$ and a 30 Amp range is equivalent to 1200 Amp/ft$^2$. They also show that sodium ions can have a positive effect on increasing the current density range but the sodium alkanol sulfonate has a much greater effect.

EXAMPLE #2

The same bath and procedure as in Example #1 was utilized but in this case the additive was sodium methyl sulfonate and current used was up to 10 Amps.

| Run # | Additive and Level | Results of Plating Tests |
|---|---|---|
| 1 | No additive | Dark burn on high current density edge at 5 Amps. |
| 2 | 10 g/l Sodium Methane Sulfonate (Calculated as Methane Sulfonic Acid) | At 10 Amps, even light gray, slightly reflective, satin deposit No burn. |
| 3 | 20 g/l Sodium Methane Sulfonate (Calculated as Methane Sulfonic Acid) | At 10 Amps, light gray satin deposit to the high current density end which was reflective. No burn. |

These results show that by adding sodium methane sulfonate to this sulfate bath the current density range is increased significantly.

EXAMPLE #3

The following experiments illustrate the inhibiting effect of the hydroxyl alkyl sulfonic acid salt in stannous sulfate/sulfuric acid solutions. The effect of iron to stabilize these stannous ion against oxidation is also illustrated when comparing Run #3 with others. Oxygen was bubbled through 150 ml of the following solutions for 64 hours at

| RUN # | $SnSO_4$ $Sn^{+2}$ g/liter | $FeSO_4$ $Fe^{+2}$ g/liter | $H_2O_4$ g/liter | $NaO_3SCH_2CH_2OH$ g/l | Decrease in $Sn^{2+}$ Conc g/l |
|---|---|---|---|---|---|
| 1 | 23 | 10 | 10 | 0 | 10.3 |
| 2 | 23 | 10 | 10 | 30 | 8.6 |
| 3 | 23 | 0 | 60 | 30 | 23 |
| 4 | 23 | 10 | 60 | 30 | 4.0 |
| 5 | 23 | 10 | 80 | 0 | 3.2 |
| 6 | 23 | 10 | 80 | 30 | 0.2 |

THEORY SECTION

While not wishing to be bound by theory, the results of the present invention are believed to be based upon the following:

The mixture of different ionic species forms a unique combination that can produce metallic coatings with required properties. It is well known that the overall ionic conductivity of the solution depends on the character of individual ionic species and their concentrations. The specific interactions between different ionic species and/or solvent molecules determine the overall conductivity and may affect electrodeposition processes. However, ionic conductivity is only one variable, which must be considered in formulating plating baths.

It is also well known that the structure of the electrical double layer can affect the rates of electrodeposition. It was proven experimentally, see for example, Lasia et al., *Journal*

*of Electroanalytical Chemistry,* 266, 68–81 (1989); Fawcett et al., *Journal of Electroanalytical Chemistry,* 279, 243–256 (1990); Lasia et al., *Journal of Electroanalytical Chemistry,* 288, 153–165 (1990) and Balch et al., *Journal of Electroanalytical Chemistry,* 427, 137–146 (1997), that the rate constant of electroreduction of certain metal ions (like $Cu^+$, $Cd^{2+}$ or $Zn^{2+}$) depends on the solvating ability of the solvent and the size of the cation of the electrolyte. The effect was attributed to the electrostatic interactions in the inner layer of the electrical double layer.

According to the Frumkin model, the rate constant for the reduction process:

$$Met^{n+}+ne \rightarrow Met^0$$

is given by:

$$lnk_f = ln(k_0 Y_M) + \alpha_a nF\phi^d/RT - \alpha_a nF(E-E_s)/RT$$

where the symbols are:

$k_f$ apparent rate constant $k_0$ potential independent portion of the rate constant $Y_M$ activity coefficient of the species $Met^{n+}$ in the bulk solution $\alpha_a$ apparent transfer coefficient for reduction n number of electrons involved in electroreduction F Faraday constant $\phi^d$ potential drop across the diffuse layer R gas constant T temperature in K E potential $E_s$ standard potential of the electroreduction reaction It is also known that the size of the counter ion of supporting electrolyte affects the $\phi^d$ potential, and as a consequence, the rate constant of overall electroreduction process (Lasia et al., Fawcett et al., and Lasia et al., supra).

It is clear that the addition of one or more salts as taught herein modifies the double layer of metal/solution interface. The modification is caused by the alkali metal cation and/or alkanol-sulfonic acid anion and/or combination of both of them (maybe alkyl-, also). Therefore, the added salt of an alkyl and/or alkanol sulfonic acid should be considered as a plating additive, rather than as a simple modification of the supporting electrolyte. In the present invention, the cation and/or anion are not added only to preserve ionic conductivity of the electrolyte and/or solubility of deposited ion(s); instead they directly affect the electrodeposition process, by affecting the double layer structure and in consequence the mechanism of the electroreduction process.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A method of improving the plating performance of an aqueous sulfate electrolyte electroplating bath comprising the step of adding an effective amount of a salt of an alkyl and/or alkanol sulfonic acid to said bath to operate said bath at higher current densities, wherein the added salt is selected from the group consisting of alkali metal, alkaline earth metal, and ammonium or substituted ammonium salts.

2. The method of claim 1, wherein the salt is a salt of 2-hydroxy ethyl sulfonic acid.

3. The method of claim 2, wherein the salt is sodium isethionate.

4. The method of claim 1, 2 or 3, wherein the electroplating bath is a tin or tin alloy electroplating bath.

5. The method of claim 1, 2 or 3, wherein the electroplating bath is a nickel or nickel alloy electroplating bath.

6. The method of claim 1, 2 or 3, wherein the electroplating bath is a copper or copper alloy electroplating bath.

7. The method of claim 1, 2 or 3, wherein the electroplating bath is a chromium or chromium alloy electroplating bath.

8. The method of claim 1, 2 or 3, wherein the electroplating bath is a cadmium or cadmium alloy electroplating bath.

9. The method of claim 1, 2 or 3, wherein the electroplating bath is an iron or iron alloy electroplating bath.

10. The method of claim 1, 2 or 3, wherein the electroplating bath is a rhodium or rhodium alloy electroplating bath.

11. The method of claim 1, 2 or 3, wherein the electroplating bath is a ruthenium or ruthenium alloy electroplating bath.

12. The method of claim 1, 2 or 3, wherein the electroplating bath is a iron/zinc electroplating bath.

13. The method of claim 1, 2, or 3, wherein the electroplating bath is a tin/zinc electroplating bath.

14. An aqueous sulfate electroplating bath comprising:

(a) a source of sulfate anions as principal electrolyte;

(b) one or more soluble platable metal salts, wherein the platable metal is selected from the group consisting of tin, nickel, copper, chromium, cadmium, iron, rhodium, ruthenium, zinc and mixtures thereof; and (c) a salt of an alkyl sulfonic acid and alkanol sulfonic acid in an effective amount to operate said bath at higher current densities, wherein the salt is selected from the group consisting of alkali meatl, alkaline earth meatl, and ammonium or substituted ammonium salts.

15. The electroplating bath of claim 14, wherein the sulfonic acid salt is a salt of 2-hydroxy ethyl sulfonic acid.

16. The electroplating bath of claim 15, wherein the salt is sodium isethionate.

* * * * *